United States Patent [19]

O'Leary

[11] Patent Number: 4,802,577

[45] Date of Patent: Feb. 7, 1989

[54] DISPLAY CONTAINER FOR A PLURALITY OF BELTS

[76] Inventor: Dennis E. O'Leary, 2635 Broadway, Suite 3, Toledo, Ohio 43609

[21] Appl. No.: 214,303

[22] Filed: Jul. 1, 1988

[51] Int. Cl.[4] ..... B65D 85/18

[52] U.S. Cl. ..... 206/278; 206/459; 206/45.34

[58] Field of Search ..... 206/278, 459, 45.34

[56] References Cited

U.S. PATENT DOCUMENTS

| | | | |
|---|---|---|---|
| 2,274,196 | 2/1942 | Gilbert . | |
| 2,442,979 | 9/1951 | Larson . | |
| 2,576,070 | 11/1951 | Howard . | |
| 2,623,685 | 12/1952 | Hill | 206/45.34 X |
| 2,806,590 | 6/1948 | Larson . | |
| 2,974,825 | 3/1961 | Ross . | |
| 2,975,888 | 3/1961 | Paynton, Sr. . | |
| 3,044,605 | 7/1962 | Clement | 206/45.34 X |
| 3,127,011 | 3/1964 | Weddle . | |
| 3,225,805 | 12/1965 | Wise | 206/45.34 |
| 4,051,992 | 10/1977 | Bergstein . | |

*Primary Examiner*—William Price

*Attorney, Agent, or Firm*—MacMillan, Sobanski & Todd

[57] ABSTRACT

A structure for containing and displaying a plurality of belts in an attractive and space-saving manner is disclosed. A hollow cylindrical body is formed from a transparent material. Upper and lower end caps are provided for closing the upper and lower open ends of the body. A solid cylindrical central spacer is disposed within the body. The central spacer is spaced apart from the upper end cap to provide an upper space within the body to accommodate at least one belt between the central spacer and the upper end cap. The central spacer is also spaced apart from the lower end cap to provide a lower space within the body to accommodate at least one belt between the central spacer and the lower end cap. The central spacer includes a slot portion extending radially inwardly from a flattened face portion. A belt buckle may be inserted within and releasably secured to the slot portion of the central spacer. A thin strip of printed material may be wrapped about the central spacer for displaying a brand name and other information thereon so as to be visually perceived through the transparent body. A lower spacer is received within the lower end cap protrusion having an axial length which is equal to the axial length of the lower end cap protrusion.

12 Claims, 1 Drawing Sheet

DISPLAY CONTAINER FOR A PLURALITY OF BELTS

BACKGROUND OF THE INVENTION

The present invention relates in general to packaging structures and in particular to a display container for a plurality of belts.

Many packaging structures are known in the art for simultaneously containing and displaying the goods therein for sale. Some of such known packaging structures are formed from a transparent material, allowing the goods to be protectively enclosed while permitting them to be seen by prospective buyers. In particular, it is known that a belt may be enclosed within a transparent container for display and sale.

SUMMARY OF THE INVENTION

The present invention relates to an improved structure for containing and displaying a plurality of belts in an attractive and space-saving manner. A hollow cylindrical body is formed from a transparent material. Upper and lower end caps are provided for closing the upper and lower open ends of the body. A solid cylindrical central spacer is disposed within the body. The central spacer is spaced apart from the upper end cap to provide an upper space within the body to accommodate at least one belt between the central spacer and the upper end cap. The central spacer is also spaced apart from the lower end cap to provide a lower space within the body to accommodate at least one belt between the central spacer and the lower end cap. The central spacer includes a slot portion extending radially inwardly from a flattened face portion. A belt buckle may be inserted within and releasably secured to the slot portion of the central spacer. A thin strip of printed material may be wrapped about the central spacer for displaying a brand name and other information thereon so as to be visually perceived through the transparent body. Each of the end caps includes a generally hollow cylindrical protrusion defining an outer diameter which is approximately equal to the inner diameter of the body for frictionally securing the end cap to the body. The terminal edges of the protrusions have outer diameters which are reduced to less than the inner diameter of the body to facilitate the insertion of the protrusion within the body. A lower spacer is received within the lower end cap protrusion having an axial length which is equal to the axial length of the lower end cap protrusion.

It is an object of the present invention to provide an improved structure for containing and displaying a plurality of belts in an attractive and space-saving manner.

It is another object of the present invention to provide such a structure with a central spacer for supporting both a belt buckle, adapted for use with each of the belts, and a strip of printed material for displaying a brand name and other information thereon so as to be visually perceived through a transparent body.

Other objects and advantages of the present invention will become apparent to those skilled in the art from the following detailed description of the preferred embodiments, when read in light of the accompanying drawings.

DETAILED DESCRIPTION OF THE PREFERRED EMBODIMENTS

Figure 1:
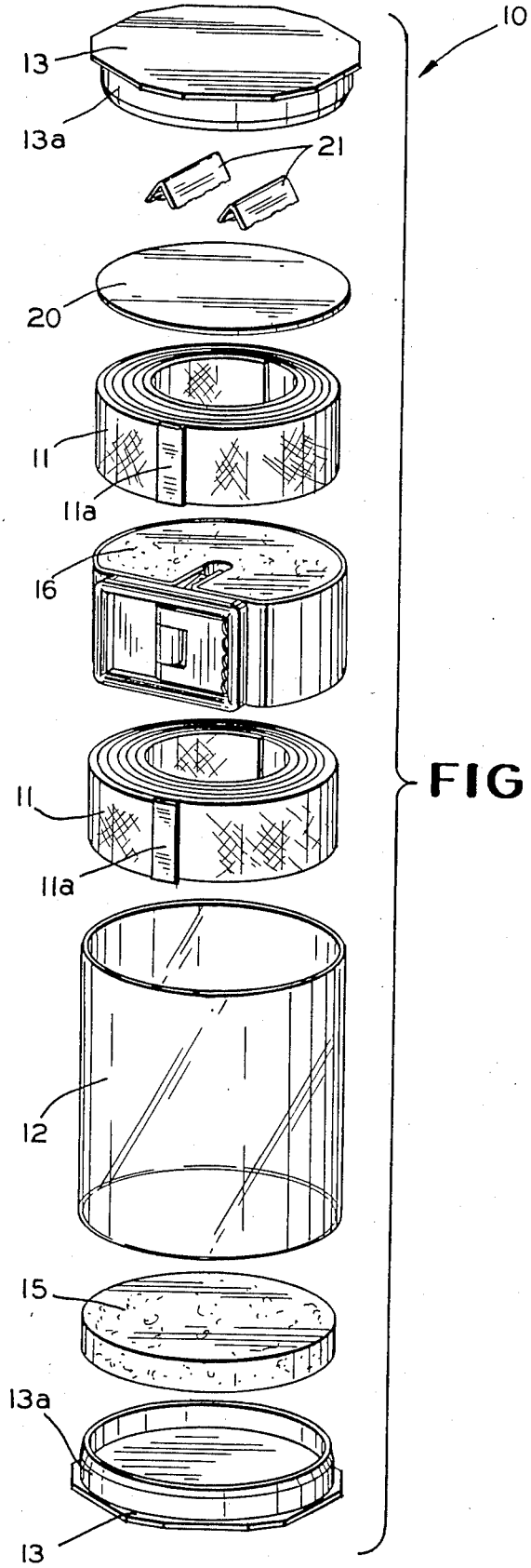
FIG. 1 is an exploded perspective view of a display container for a plurality of belts in accordance with the present invention.

Referring now to the drawings, there is illustrated in FIG. 1 a display container, indicated generally at 10, for a plurality of belts 11 in accordance with the present invention. The display container 10 is generally elongated and cylindrical in shape and includes a thin tubular body 12 formed from a lightweight transparent material, such as plastic. Upper and lower end caps 13 are provided for closing the upper and lower open ends of the body 12. Each of the end caps 13 is formed from a rigid plastic material and includes an integral protrusion 13*a* extending therefrom. The protrusions 13*a* are generally hollow and cylindrical in shape, defining outer diameters which are approximately equal to the inner diameter of the body 12. Thus, the end caps 13 can be frictionally secured to the ends of the body 12 by axially inserting the protrusions 13*a* within the body 12. The terminal edges of the protrusions 13*a* have outer diameters which are reduced slightly to less than the inner diameter of the body 12, thereby facilitating the insertion of the protrusions 13*a* within the body 12.

To assemble the display container 10, the lower end cap 13 is initially secured to the lower end of the body 12 as described above. A solid cylindrical lower spacer 15 can be first inserted within the cylindrical space defined by the protrusion 13*a* . Preferably, the lower spacer 15 has an axial length which is approximately equal to the axial length of the protrusion 13*a*. The lower spacer 15 can be formed from any rigid material, but foamed polystyrene is preferred because of its light weight and low cost. The function of the lower spacer 15 will be explained in detail below.

Next, one of the belts 11 is inserted within the body 12. As best shown in FIG. 1, each of the belts 11 is wrapped about itself to form a generally cylindrical shape having an outer diameter which is slightly smaller than the inner diameter of the body 12. When the belt 11 is inserted within the body 12 and moved downwardly therein, it contacts both the terminal edge of the lower protrusion 13*a* and the upper surface of the lower spacer 15. Since the upper surface of the lower spacer 15 is flush with the terminal edge of the protrusion 13*a*, the belt 12 is supported in its cylindrical shape within the body 12. If the lower spacer 15 was not present, the outer winding of the belt 12 would rest upon the terminal edge of the protrusion 13*a*, while the inner windings thereof would undesirably sag downwardly within the protrusion 13*a*.

One end of each of the belts 11 has a metallic guard 11*a* secured thereto to prevent the belt material from fraying. The other ends of the belts 11 do not have the guards 11*a* attached to the ends thereof, nor do they have buckles connected thereto. Rather, the belt material simply terminates in an end portion, which can be use in a manner described in detail below. Although FIG. 1 shows only one of the belts 11 being inserted within the body 12 adjacent to the lower end cap 13, any convenient number of belts 11 may be so inserted, as demonstrated in FIG. 3.

Figure 2:
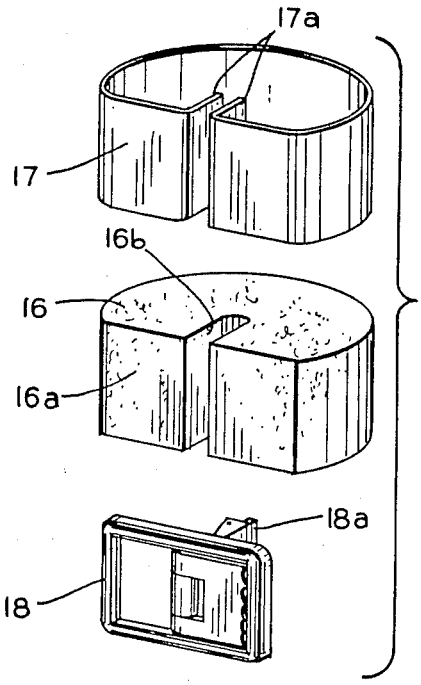
FIG. 2 is an exploded perspective view of the central spacer and its associated components shown in FIG. 1.

After the desired number of belts 11 have been inserted within the body 12, a central spacer 16 is inserted therein. The structure of the central spacer 16 is more clearly illustrated in FIG. 2. The central spacer 16 is generally solid and cylindrical in shape, having an outer diameter which is slightly smaller than the inner diameter of the body 12. The central spacer 16 is formed having a flattened face portion 16*a*. A slot portion 16*b* is formed through the central spacer 16 extending radially inwardly from the flattened face portion 16*a*. The central spacer 16 may be formed from the same material as the lower spacer 15. A thin strip 17 of paper or other flexible material can be wrapped about the central spacer 16 such that it is disposed between the outer surface of the central spacer 16 and the inner surface of the body 12. The strip 17 has opposed end portions 17*a* which are bent inwardly so as to be received within the slot portion 16*b* of the central spacer 16 when wrapped thereabout. The outer surface of the strip 17 may be printed with a brand name or other identifying or decorative indicia (not shown), which may be visually perceived through the transparent body 12.

The slot portion 16*b* on the central spacer 16 also provides a mounting means for a conventional belt buckle 18. The belt buckle 18 is of the frictional retaining type, although such is not required, and includes a pivotable locking arm portion 18*a*. A single belt buckle 18 is provided for interchangeable use with all of the belts 11 packaged within the display container 10. The slot portion 16*b* of the central spacer 16 is sized such that the locking arm portion 18*a* can be frictionally retained therein in a releasable fashion between the end portions 17*a* of the strip 17. When the pivotable arm portion 18*a* is so engaged, the end portions 17*a* of the strip 17 are also secured to the central spacer 16 such that the strip 17 is retained thereon. Thus, the strip 17 is prevented from becoming dislodged from the central spacer 16 during assembly of the display container 10 and thereafter.

After the central spacer 16, the strip 17, and the belt buckle 18 have been inserted within the display container 10, a second belt 11 (or additional belts) can be inserted therein. Next, a circular card 20 is inserted within the display container 10. The circular card 20 has an outer diameter which is slightly smaller than the inner diameter of the body 12 and can be formed of any inexpensive material, such as paper or cardboard. The card 20 is provided to support any additional hardware supplied for use with the belts 11. For example, a plurality of V-shaped clips 21 may be provided for use with the belts 11. The clips 21 are provided for the same purpose as the guards 11*a* described above. A purchaser of the belts 11 can custom trim each belt 11 to his or her waist length, then crimp one of the clips 21 over the trimmed end thereof to prevent the belt material from fraying. The card 20 is provided to retain the clips 21 within the cylindrical space defined within the upper protrusion 13*a* of the upper end cap 13 when it is secured to the upper of the body 12 to complete the display container 10.

The assembled display container 10 provides an attractive, space-efficient, and inexpensive container and display apparatus for a plurality of belts 11. Not only are the belts 11 displayed in a unique and attractive manner, but the associated belt buckle 18 is also mounted for easy viewing through the body 12. Also, the other hardware for the belts 11 (such as the guards 21) is retained within a predetermined space in the display container 10 and thereby prevented from falling throughout the inner portion of the body 12.

Figure 3:
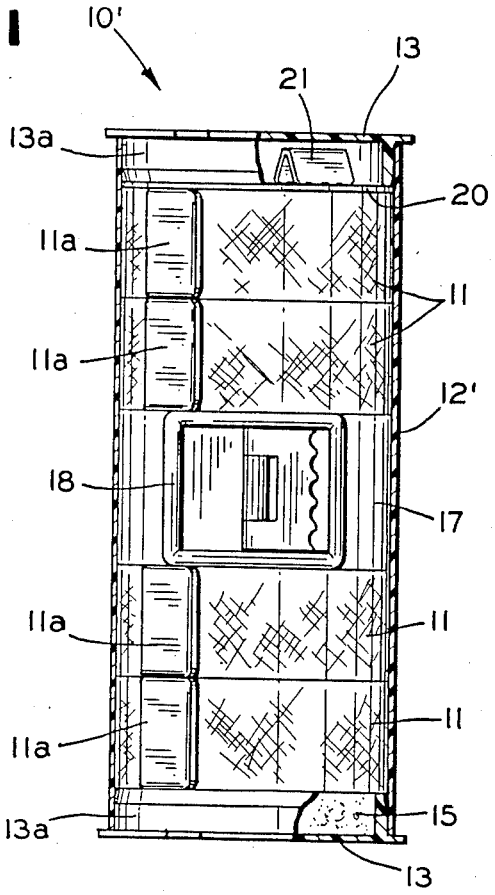
FIG. 3 is an elevational view, partially broken away, of a slightly modified version of the display container illustrated in FIG. 1.

As shown in FIG. 3, a slightly modified embodiment of the display container 10' contemplates that more than one belt 11 be disposed on each side of the central spacer 16 within a body 12' having a greater axial length than the body 12 discussed above. From this embodiment, it will be appreciated that any number of belts 11 may be disposed within the display container 10' in a similar fashion. The axial length of the body 12' will be determined by the number of such belts 11 desired to be contained therein.

In accordance with the provisions of the patent statutes, the principle and mode of operation of the present invention have been explained and illustrated in its preferred embodiments. However, it must be understood that the present invention may be practiced otherwise than as specifically explained and illustrated without departing from its spirit or scope.

What is claimed is:

1. A display container for a plurality of belts comprising:

a hollow body having upper and lower open ends, said body being formed from a transparent material;

upper and lower end caps for closing said upper and lower open ends of said body; and central spacer means disposed within said body, said central spacer means being spaced apart from said upper end cap to provide an upper space within said body for at least one belt disposed between said central spacer means and said upper end cap and being spaced apart from said lower end cap to provide a lower space within said body for at least one belt disposed between said central spacer means and said lower end cap.

2. The invention defined in claim 1 wherein said body portion defines an inner dimension and wherein said lower end cap includes a generally hollow protrusion defining an outer dimension which is approximately equal to the inner dimension of said body for frictionally securing said lower end cap to said body, the terminal edge of said protrusion having an outer dimension which is reduced to less than said inner dimension of said body to facilitate the insertion of said protrusion within said body.

3. The invention defined in claim 2 further including lower spacer means received within said lower end cap protrusion, said lower spacer means having an axial length which is equal to the axial length of said lower end cap protrusion.

4. The invention defined in claim 1 wherein said central spacer means further includes a strip of material wrapped thereabout and disposed between said central spacer means and said body.

5. The invention defined in claim 1 wherein said central spacer means is generally solid and includes a flattened face portion.

6. The invention defined in claim 5 wherein said central spacer means includes a slot portion extending inwardly from said flattened face portion.

7. The invention defined in claim 6 further including a belt buckle having a portion inserted within and releasably secured to said slot portion of said central spacer means.

8. The invention defined in claim 6 wherein said central spacer means further includes a strip of material wrapped thereabout and disposed between said central spacer means and said body.

9. The invention defined in claim 8 wherein said strip of material includes a pair of end portions received within said slot portion of said central spacer means.

10. The invention defined in claim 9 further including a belt buckle having a portion inserted within and releasable secured to said slot portion of said central spacer means.

11. The invention defined in claim 1 wherein said body portion defines an inner dimension and wherein said upper end cap includes a generally hollow protrusion defining an outer dimension which is approximately equal to the inner dimension of said body for frictionally securing said upper end cap to said body, the terminal edges of said protrusion having an outer dimension which is reduced to less than said inner dimension of said body to facilitate the insertion of said protrusion within said body.

12. The invention defined in claim 11 further including card means disposed adjacent to said upper end cap protrusion, said card means being sized to close said upper end cap protrusion.

* * * * *